US007205469B2

(12) United States Patent
Chang

(10) Patent No.: US 7,205,469 B2
(45) Date of Patent: Apr. 17, 2007

(54) DRUM BRACKET

(75) Inventor: Ming Yi Chang, Taichung (TW)

(73) Assignee: Remarkable Company, Taichung (TW)

( * ) Notice: Subject to any disclaimer, the term of this patent is extended or adjusted under 35 U.S.C. 154(b) by 173 days.

(21) Appl. No.: 11/052,079

(22) Filed: Feb. 8, 2005

(65) Prior Publication Data

US 2006/0174750 A1 Aug. 10, 2006

(51) Int. Cl.
*G10D 13/02* (2006.01)

(52) U.S. Cl. ..... 84/421; 248/346.06

(58) Field of Classification Search ..... 84/421, 84/422.1, 422.2; 248/346.06
See application file for complete search history.

(56) References Cited

U.S. PATENT DOCUMENTS 6,416,029 B1 * 7/2002 Holtermanns ..... 248/346.06

2005/0103184 A1 * 5/2005 Hsieh ..... 84/421

* cited by examiner

*Primary Examiner*—Lincoln Donovan
*Assistant Examiner*—Jianchun Qin
(74) *Attorney, Agent, or Firm*—Rosenberg, Klein & Lee

(57) ABSTRACT

A drum bracket including an adjustment rod and three support bars pivotally connected with upper end of the adjustment rod at equal angular intervals. Each support bar has a swinging end. An L-shaped claw section is pivotally connected with the swinging end of each support bar and fixable with the support bar. A bush is axially movably fitted on the adjustment rod. Three links are pivotally connected with the bush at equal angular intervals. Each link is also pivotally connected with a middle section of each support bar. A bottom of the adjustment rod is formed with outer thread under the bush. An adjustment nut is screwed on the outer thread.

2 Claims, 7 Drawing Sheets

DRUM BRACKET

BACKGROUND OF THE INVENTION

The present invention is related to an improved drum bracket having claw sections for holding a drum. The angle of the claw sections can be adjusted for firmly clamping different sizes of drums.

A percussion instrument such as a drum is generally supported with a bracket to facilitate the performance. FIG. 5 shows a conventional drum bracket 6 mounted on a tripod 7. The bracket 6 has an adjustment rod 61 and three support bars 63 pivotally connected with top end of the adjustment rod 61 at equal angular intervals. A free end of each support bar 63 has a claw section 64. A bush 65 is fitted around the adjustment rod 61. A link 66 is pivotally connected between the bush 65 and the middle section of each support bar 63. An adjustment nut 62 is screwed on the bottom of the adjustment rod 61 for adjusting the stretching angle of the support bars 63.

The drum 5 is fixed on the bracket 6 in such a manner that the drum 5 is placed on the stretched support bars 63 and held by the claw sections 64. Then the adjustment nut 62 is screwed to clamp and fix the drum 5 as shown in FIG. 6.

The claw section 64 of the bracket 6 is a fixed and bent structure with a right angle. When the support bars 63 are inward contracted, the holding diameter of the claw sections 64 is narrowed. However, the claw sections 64 will be biased along with the adjusted support bars. As shown in FIG. 7, in the case that the drum is placed in a contracted bracket 6, the claw sections 64 can hardly fully hold and support the bottom rim of the drum frame. As a result, the drum cannot be firmly fixed.

The existent drums have 8-inch drumhead, 10-inch drumhead, 12-inch drumhead, 13-inch drumhead and 14-inch drumhead. Each size of drum necessitates a specific size of bracket. It is impossible for one single bracket to support various sizes of drums. Therefore, a performer often needs to prepare many types of brackets for supporting different sizes of drums. It is quite inconvenient to transfer and store these brackets.

SUMMARY OF THE INVENTION

It is therefore a primary object of the present invention to provide an improved drum bracket in which claw sections are pivotally connected with support bars. The angle of the claw sections can be adjusted for firmly clamping different sizes of drums.

According to the above object, the drum bracket of the present invention includes an adjustment rod and three support bars pivotally connected with upper end of the adjustment rod at equal angular intervals. Each support bar has a swinging end. A claw section is pivotally connected with the swinging end of each support bar and fixable with the support bar. A bush is axially movably fitted on the adjustment rod. Three links are pivotally connected with the bush at equal angular intervals. Each link is also pivotally connected with a middle section of each support bar. A bottom of the adjustment rod is formed with outer thread under the bush. An adjustment nut is screwed on the outer thread.

The present invention can be best understood through the following description and accompanying drawings wherein:

DETAILED DESCRIPTION OF THE PREFERRED EMBODIMENTS

Figure 1:
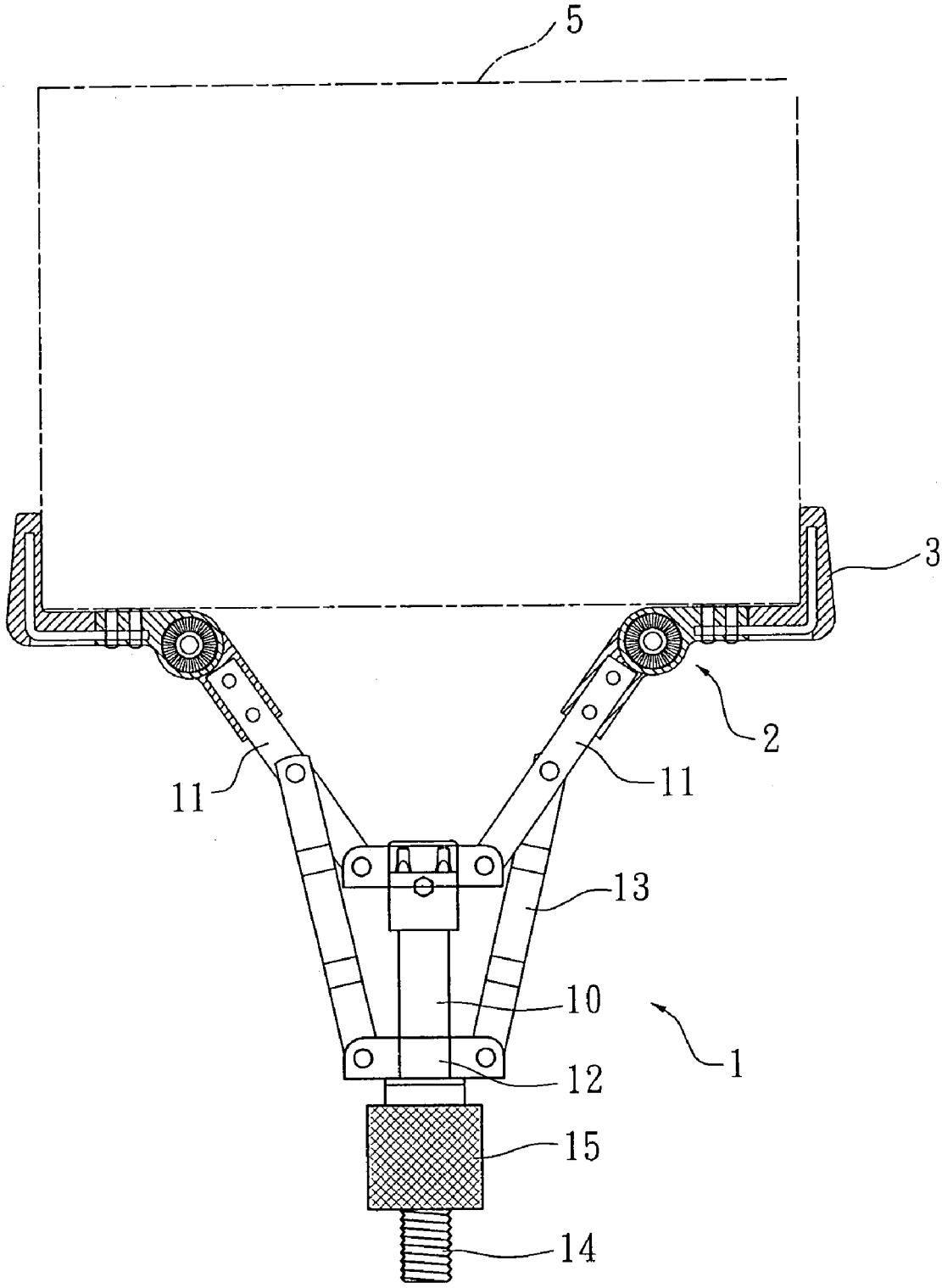
FIG. 1 is a plane view of the drum bracket of the present invention.
Figure 2:
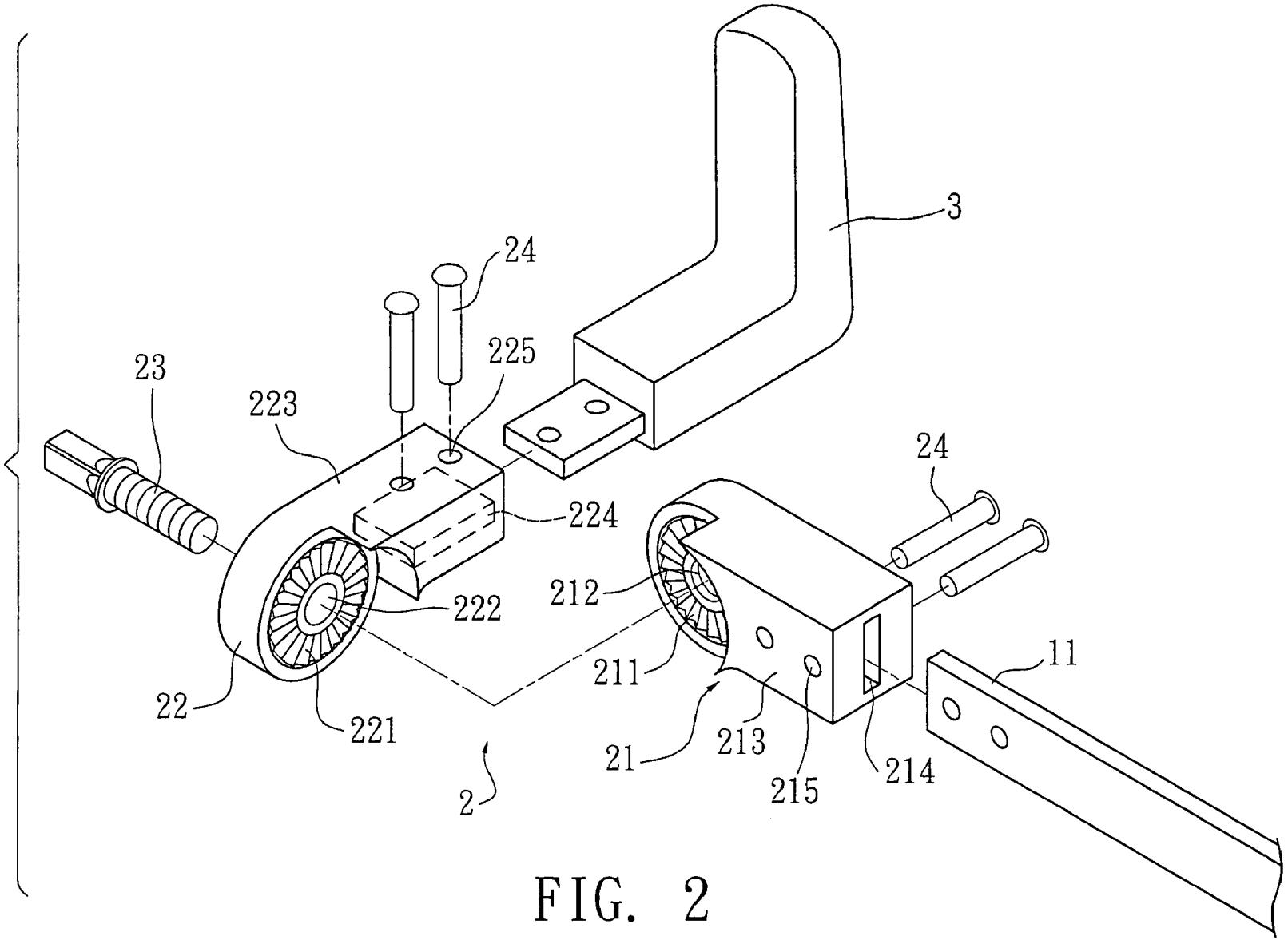
FIG. 2 is a perspective exploded view of the elbow of the drum bracket of the present invention.
Figure 3:
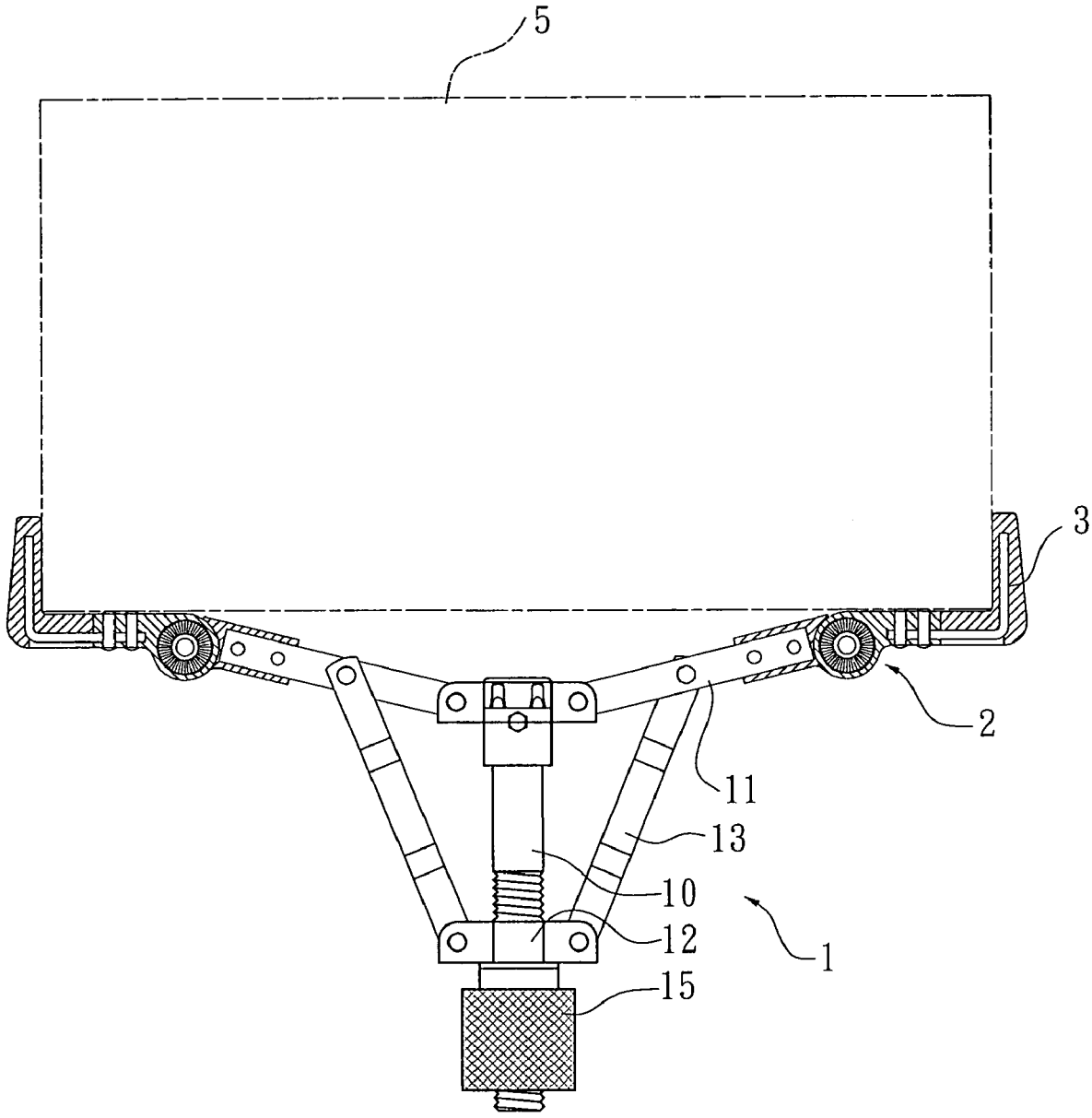
FIG. 3 is a plane view of the drum bracket of the present invention, in which the claw sections are stretched for holding a larger size of drum.

Please refer to FIGS. 1 to 3. The drum bracket 1 of the present invention includes an adjustment rod 10 and three support bars 11 pivotally connected with upper end of the adjustment rod 10 at equal angular intervals. Each support bar 11 has a swinging end. A bush 12 is axially movably fitted around the adjustment rod 10. Three links 13 are pivotally connected with the bush 12 at equal angular intervals. Each link 13 is also pivotally connected with a middle section of each support bar 11. The bottom of the adjustment rod 10 is formed with outer thread 14 on which an adjustment nut 15 is screwed under the bush 12.

An elbow 2 is fixed at the swinging end of each support bar 11. Each elbow has a fixed block 21 and a rotary block 22 pivotally disposed on the fixed block. The opposite faces of the fixed block 21 and the rotary block 22 are formed with annular toothed sections 211, 221 which are engaged with each other. The fixed block 21 is formed with a central thread hole 212 and the rotary block 22 is formed with a central through hole 222. A bolt 23 is passed through the through hole 222 and screwed into the thread hole 212 for fixing the rotary block.

The fixed block has an axially extending section 213 formed with an insertion socket 214 for the swinging end of the support bar to fit therein. The rotary block has an axially extending section 223 formed with an insertion socket 224 for an L-shaped claw section 3 to fit therein. At least one through hole 215, 225 is formed on a lateral side of each extending section 213, 223. A rivet 24 is inserted through the through hole 215, 225 to fix the support bar and the claw section on the elbow 2.

According to the above arrangement, when the support bars 11 are outward stretched, two ends of the claw section 3 can be kept horizontal and vertical. Accordingly, a range of holding diameter is defined for firmly holding the drum.

When the holding diameter of the claw sections is changed from that of FIG. 1 to that of FIG. 3, a user only needs to screw the adjustment nut 15 of the adjustment rod to move the bush 12 upward. Accordingly, the outward stretching angle of the support bars 11 can be changed. Also, after the bolt 23 is unscrewed, the angle of the rotary block 22 of the elbow 2 can be freely adjusted. Then the bolt is re-screwed to engage the annular toothed sections 221, 211 of the rotary block 22 and fixed block 21 with each other. Therefore, the rotary block 22 is fixed on the fixed block 21. Accordingly, the claw sections 3 can fully support and hold the drum 5.

According to the above arrangement, the angle of the claw sections can be adjusted for truly clamping different sizes of drums.

Figure 4:
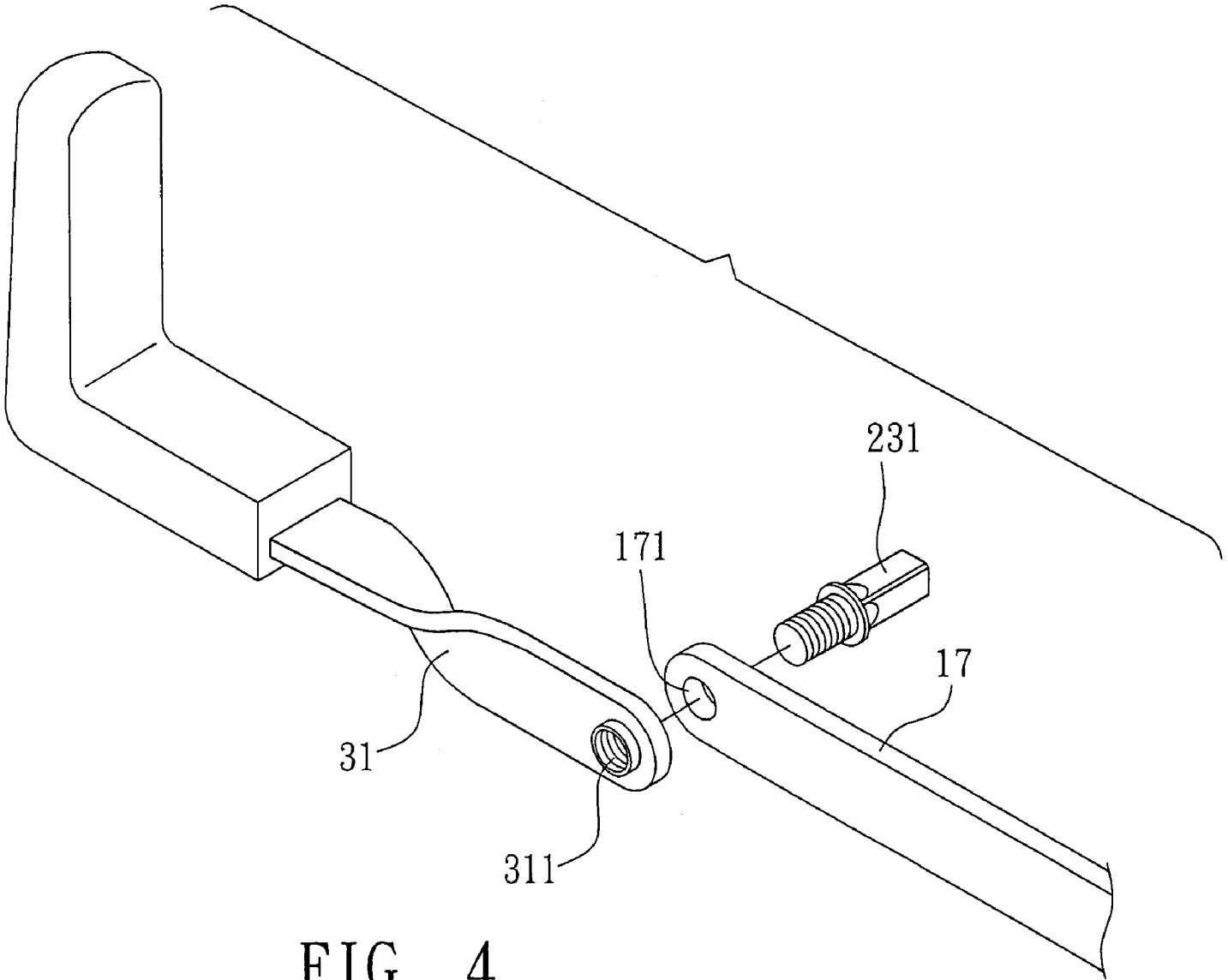
FIG. 4 is a perspective exploded view of another embodiment of the drum bracket of the present invention.
Figure 5:
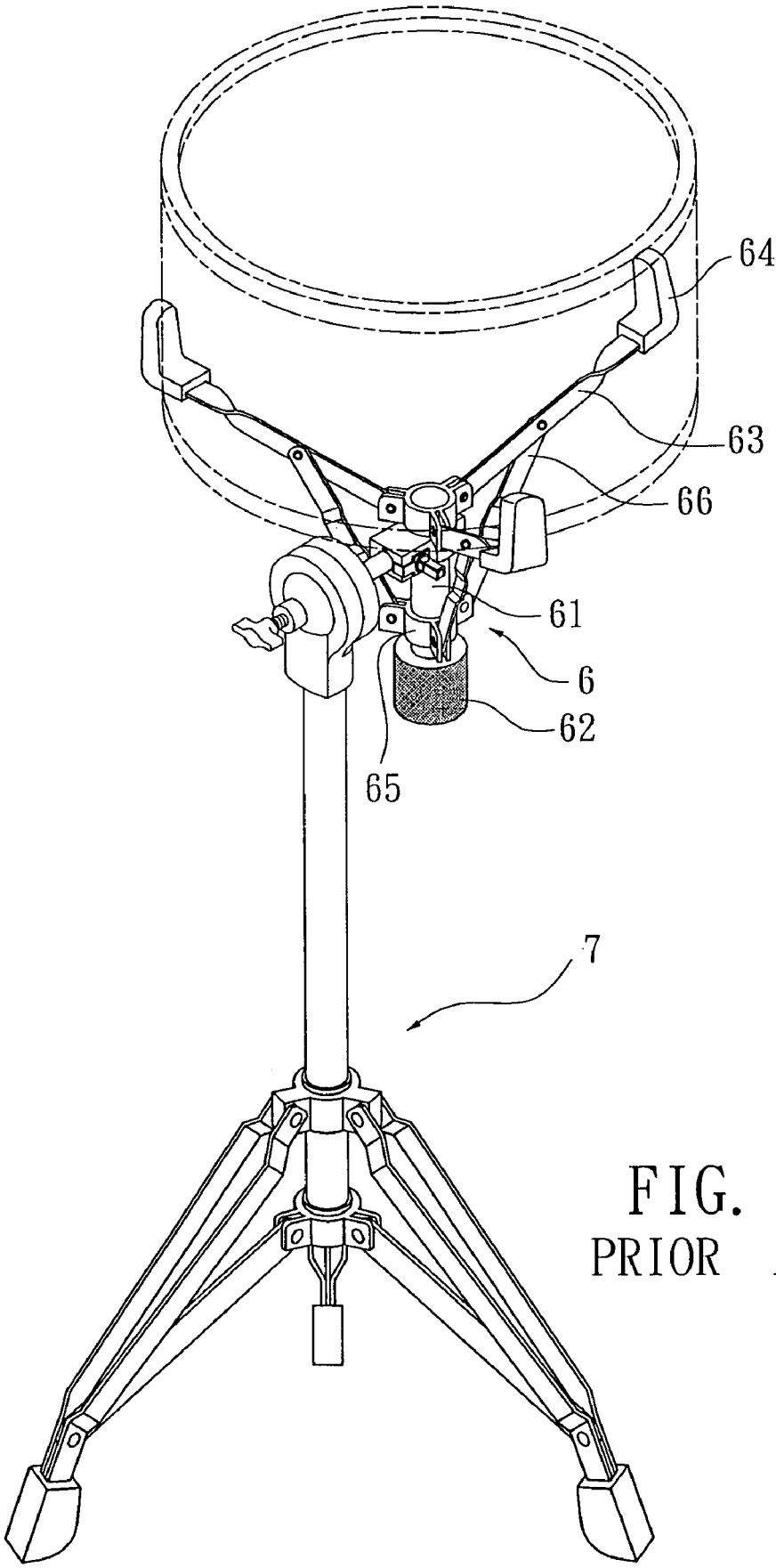
FIG. 5 PRIOR ART
FIG. 5 is a perspective view of a conventional drum bracket mounted on a tripod.
Figure 6:
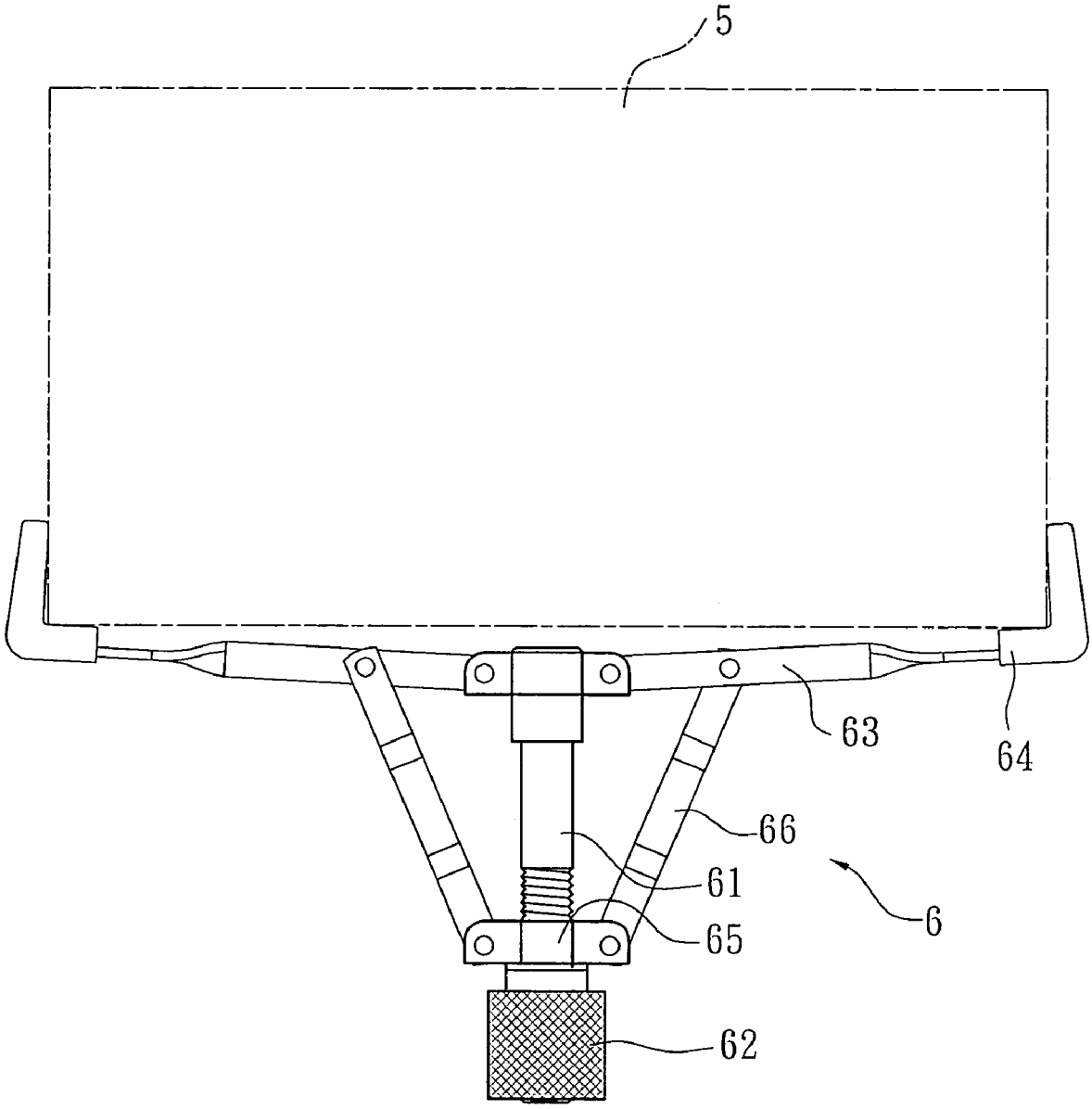
FIG. 6 PRIOR ART
FIG. 6 is a plane view showing that the conventional drum bracket holds a larger size of drum.
Figure 7:
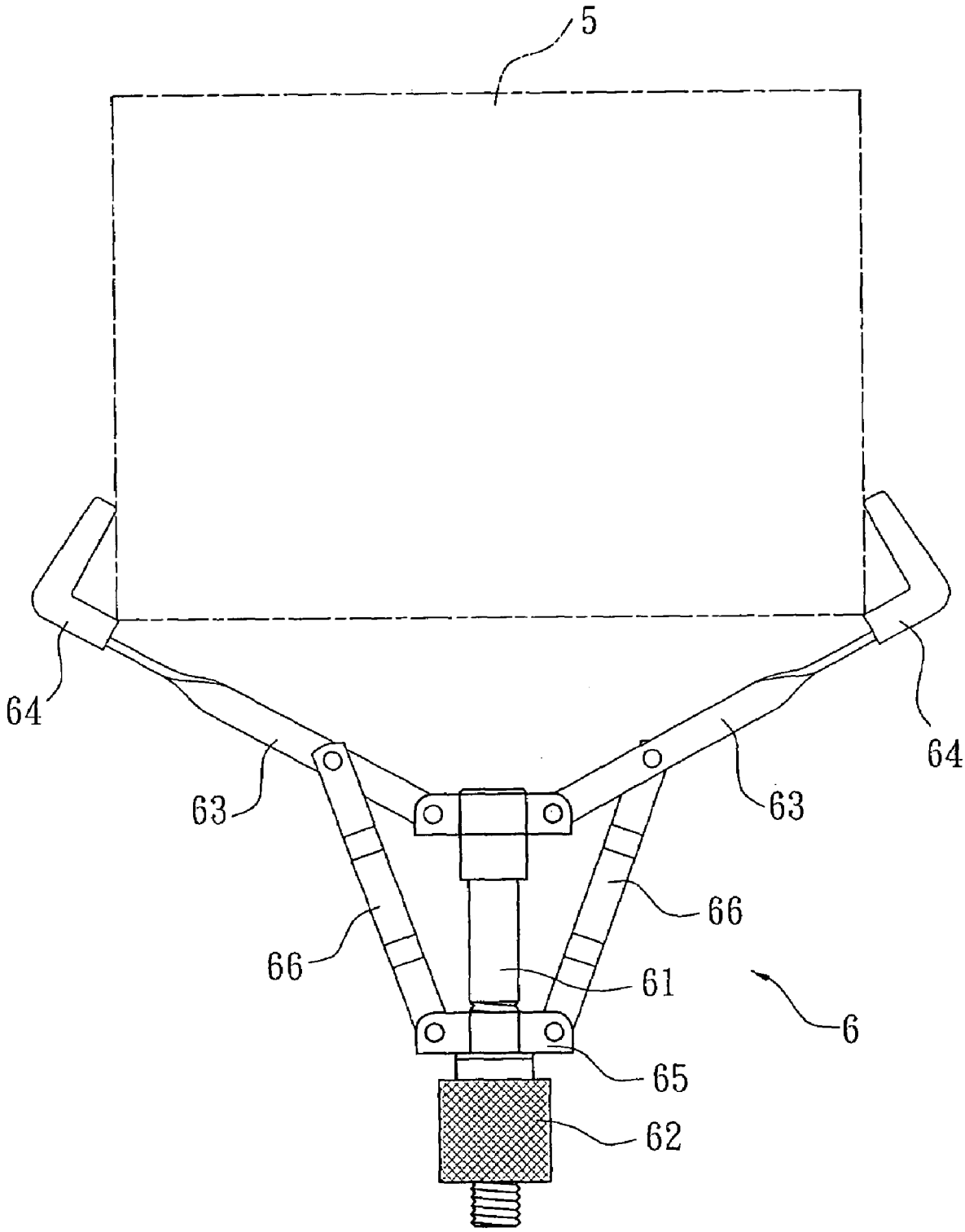
FIG. 7 PRIOR ART
FIG. 7 is a plane view showing that the support bars of the conventional drum bracket are contracted to hold a smaller size of drum.

FIG. 4 shows a second embodiment of the drum bracket of the present invention. The swinging end of each support bar 17 is formed with a hole 171. One end of the claw section 31 is formed with a thread hole 311 corresponding to the hole of the support bar 17. A bolt 231 is passed through the hole 171 and screwed into the thread hole 311 to fix the claw section 31 with the support bar 17. Similarly, the angle of the claw section 31 can be adjusted for holding different sizes of drums.

The above embodiments are only used to illustrate the present invention, not intended to limit the scope thereof. Many modifications of the above embodiments can be made without departing from the spirit of the present invention.

What is claimed is:

1. A drum bracket comprising an adjustment rod and three support bars pivotally connected with upper end of the adjustment rod at equal angular intervals, each support bar having a swinging end, a bush being axially movably fitted on the adjustment rod, three links being pivotally connected with the bush at equal angular intervals, each link being also pivotally connected with a middle section of each support bar, a bottom of the adjustment rod being formed with outer thread under the bush, an adjustment nut being screwed on the outer thread, said drum bracket being characterized in that an L-shaped claw section is pivotally connected with the swinging end of each support bar and fixable with the support bar;

wherein the swinging end of each support bar is pivotally connected with the L-shaped claw section via an elbow, the elbow having a fixed block and a rotary block pivotally disposed on the fixed block, two opposite faces of the fixed block and the rotary block being formed with annular toothed sections which are engaged with each other, the fixed block being formed with a central thread hole and the rotary block being formed with a central through hole, a bolt being passed through the through hole and screwed into the thread hole for fixing the rotary block, the fixed block having an axially extending section formed with an insertion socket for the swinging end of the support bar to fit therein, the rotary block having an axially extending section formed with an insertion socket for the L-shaped claw section to fit therein, at least one through hole being formed on a lateral side of each extending section, a rivet being inserted through the through hole to fix the support bar and the claw section on the elbow.

2. The drum bracket as claimed in claim 1, wherein the swinging end of each support bar is formed with a hole and one end of the claw section is formed with a thread hole corresponding to the hole of the support bar, a bolt being passed through the hole of the support bar and screwed into the thread hole of the claw section to fix the claw section with the support bar.

* * * * *